United States Patent [19]

Rush, Jr. et al.

[11] Patent Number: 4,857,681

[45] Date of Patent: Aug. 15, 1989

[54] DEAD MAN-TYPE ELECTRICAL CONTROL DEVICE FOR POWER TOOLS

[75] Inventors: Robert W. Rush, Jr., Amherst, Ohio; Michael K. Huizenga, Tupelo, Miss.

[73] Assignee: Aircap Industries Corp., Topelo, Miss.

[21] Appl. No.: 136,965

[22] Filed: Dec. 23, 1987

Related U.S. Application Data

[63] Continuation-in-part of Ser. No. 108,004, Oct. 14, 1987, abandoned.

[51] Int. Cl.[4] ..... H01H 9/06

[52] U.S. Cl. ..... 200/61.85; 200/332.2

[58] Field of Search ..... 200/157, 61.85, 334, 200/332.2, 293.1

[56] References Cited

FOREIGN PATENT DOCUMENTS 1533476 11/1978 United Kingdom ..... 200/61.85

*Primary Examiner*—A. D. Pellinen

*Assistant Examiner*—Morris Ginsburg

*Attorney, Agent, or Firm*—Watson, Cole, Grindle & Watson

[57] ABSTRACT

A control for an electrical tool, particularly of the garden tool type, comprises a housing containing an electrical switch having a projecting actuator and a handle assembly for switching the electrical switch from a deactivated condition to an activated condition by contact with the actuator. The handle assembly comprises an elongated handle projecting from the housing and pivotably attached to the housing by a pivot with one end of the handle adjacent to one side of the actuator. The handle assembly also includes an elongated trigger pivotably attached to the handle with an end projecting outside the housing and the other end adjacent to another side of the switch actuator. The handle further includes a spring biasing the handle and therefore the actuator towards the adjacent end of the trigger.

6 Claims, 1 Drawing Sheet

FIG. 1
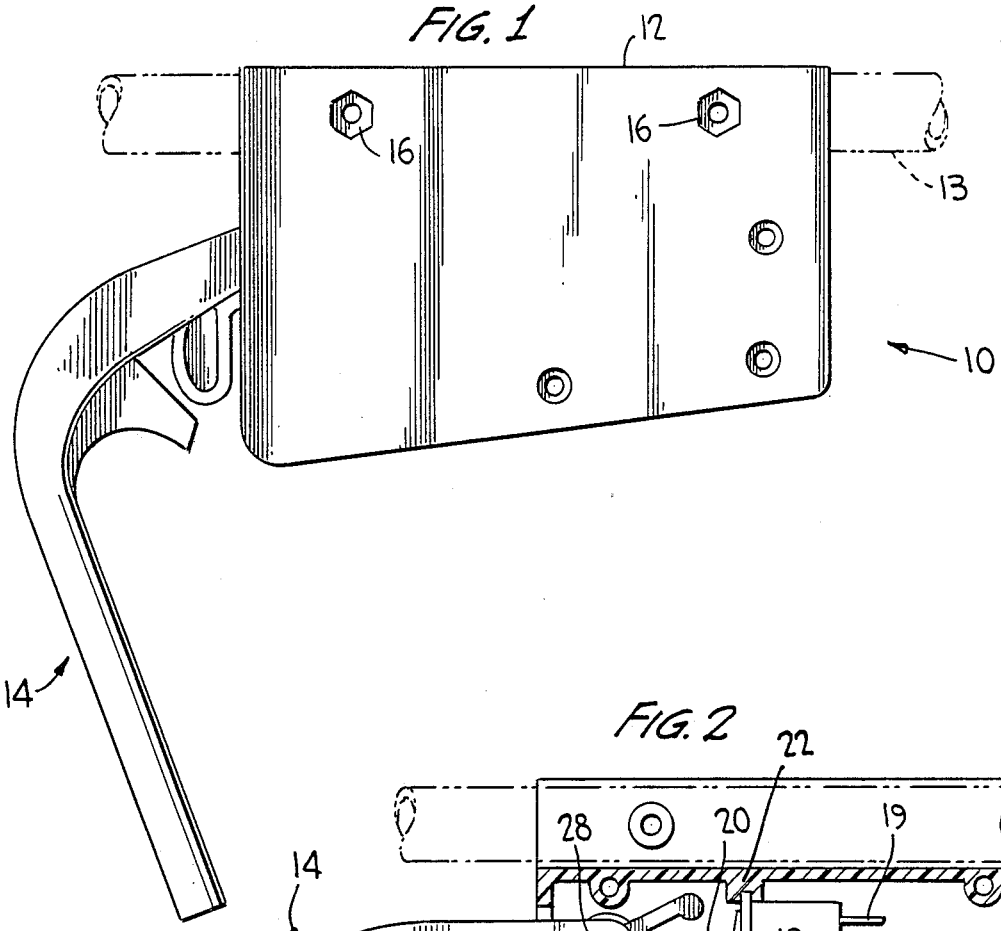
FIG. 2
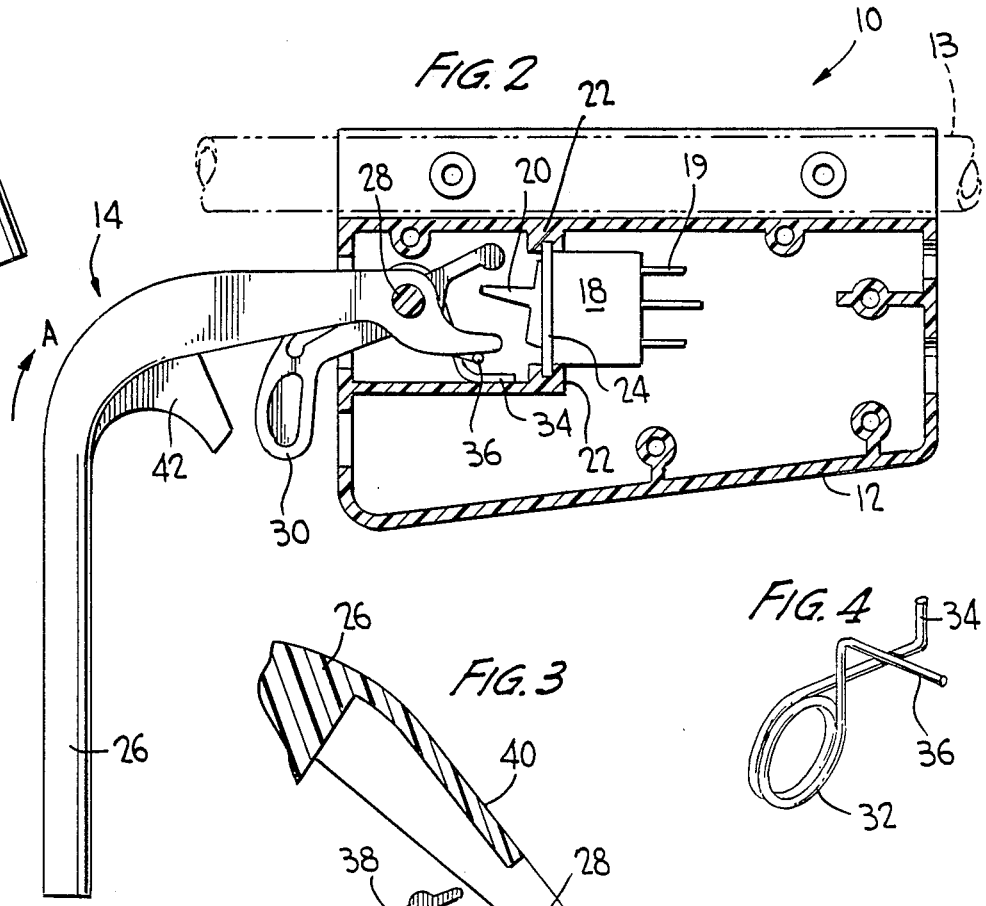
FIG. 3
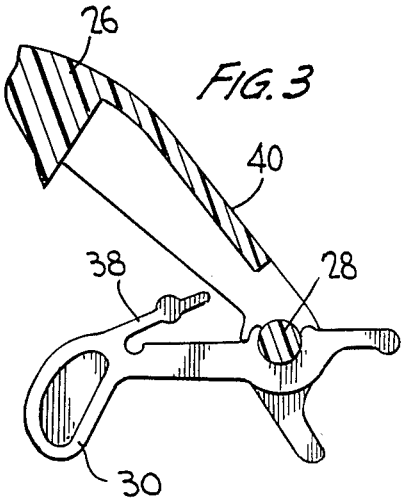
FIG. 4

DEAD MAN-TYPE ELECTRICAL CONTROL DEVICE FOR POWER TOOLS

CROSS-REFERENCE TO RELATED APPLICATION

This application is a continuation-in-part of U.S. application Ser. No. 108,004, filed Oct. 14, 1987, now abandoned.

BACKGROUND OF THE INVENTION

The present invention relates generally to electrical control switches and, more particularly, to so-called "dead-man" type control switches which may be used to actuate the operation of small electrically powered garden tools such as mowers, trimmers and the like.

For a number of years, the U.S. Product Safety Commission has required that certain new electrical power tools such as lawn mowers and the like be equipped with an actuator of the type which all automatically stop the operation of the tool when the operator releases the actuator. Actuators of this type help prevent accidental injury to the operator as it makes it difficult for the operator to approach the moving parts of the tool while the tool is still actuated. Furthermore, the Commission has required that the actuator for the tool be of the type which requires the operator to perform two separate or distinct functions in order to activate the tool in order to minimize inadvertent or accidental operation of the tool. Such an actuation also makes it more difficult for children to operate the tool.

There are numerous designs for such actuators presently being incorporated into new power tools. While most operate satisfactorily for their intended purpose, many suffer from the disadvantages that they are difficult for the operator to actuate, they are physically taxing to maintain in the actuated position and they are relatively complicated in construction and thus are difficult and expensive to manufacture.

SUMMARY OF THE INVENTION

It is therefore an object of the present invention to provide an electrical control device for a power tool which is relatively easy to manipulate and which minimizes fatigue of the operator during prolonged actuation.

Another object of the invention is to provide an electrical control for a power tool which is of a simple construction and is therefore quite easy to manufacture.

It is a further feature of the invention to provide an electrical control device for a power tool which provides essentially immediate action to deactivate the tool when the operator releases his grip on the control device.

Briefly, in its broader aspects, the present invention comprehends an electrical control device for an electrical tool, the control device comprising a housing containing an electrical switch having a projecting actuator, and a handle assembly for switching the electrical switch from a deactivated (off) condition to an activated (on) condition by contact with the actuator, the handle assembly comprising an elongated handle element projecting from the housing and pivotably attached to the housing by a pivot with one end of the handle element adjacent to one side of the actuator, an elongated trigger element pivotably attached to the handle element with an end projecting outside the housing and the other end adjacent to another side of the switch actuator, and biasing means forcing the actuator towards the adjacent end of the trigger.

Further objects, advantages and features of the present invention will become more fully apparent from a detailed consideration of the arrangement and construction of the constituent parts as set forth in the following description taken together with the accompanying drawing.

BRIEF DESCRIPTION OF THE DRAWINGS

In the drawings,

FIG. 1 is a plan view of an electrical control device in accordance with the present invention,

FIG. 2 is a plan view of the electrical control device similar to FIG. 1, but wherein the housing of the electrical control device is depicted partly in cross section so as to show the elements therein, and wherein the elongated handle element is thereof shown rotated clockwise relative to its positioning indicated in FIG. 1, FIG. 3 is a cross-sectional view of a portion of the handle assembly thereof, and FIG. 4 is a perspective view of a coil-type spring used in the handle assembly.

DETAILED DESCRIPTION OF THE PREFERRED EMBODIMENT

Turning first to FIG. 1, electrical control 10 of the present invention comprises a generally rectangular housing 12 and a protruding handle assembly 14. Housing 12 is adapted to be secured to a tubular member 13 (shown in dashed lines) forming part of a tool by means of bolts 16, the member passing through a portion of the housing. The tubular member 13 may be, for example, part of the handle of an electric lawn mower.

In FIG. 2, the interior of housing 12 is illustrated partly in cross-section. Housing 12 contains snap-action toggle switch 18 with projecting actuator 20. Terminals 19 of the toggle switch are adapted to be connected to electrical wires (not shown) extending from housing 12 to the motor of the tool and to a source of electricity. Switch 18 is of conventional construction and need not be discussed in any great detail. Swtich 18 is securely held within housing 12 by interior walls 22 engaging flange 24 of the switch. Actuator 20 of switch 18 is shown in FIG. 2 in the deactivated or off position.

Handle assembly 14 serves to move actuator 20 of switch 18 into the activated or on position, i.e., pointing downwardly and to the left in the drawing. Handle assembly 14 comprises L-shaped handle element 26 pivotably mounted within housing 12 on pivot 28, trigger element 30 mounted for rotation on the pivot and coil spring 32 about the bottom of the pivot. The interior end of handle element 26 is located on one side of actuator 20 and the interior end of trigger element 30 is located on the opposite side of the actuator. Coil spring 32 is mounted about pivot 28 and includes an end 36 extending beneath the interior end of handle element 26. End 34 of coil spring 32 (see FIG. 4) abuts wall 22 of the housing to prevent rotation of the spring about pivot 28. The end 36 of the spring tends to bias the interior end of handle element 26 against the actuator 20 of switch 18 so as to move into the off position (the position shown in FIG. 2).

As is best shown in the detailed view of FIG. 3, trigger 30 has a semi-circular portion which enables the trigger element to be snap-fit about pivot 28 of handle element 26 and thus able to rotate relative to the handle element. Trigger element 30 also includes projecting arm 38 which is adapted to contact wall 40 of handle element 26 upon appropriate rotation and thereby act as a spring means to urge the exterior end of the trigger element away from the wall 40 of the handle element by counterclockwise rotation around the pivot 28 (as seen in FIG. 3). Handle element 26 is provided with guard 42 which helps prevent operation of trigger element 30 until the handle element 26 has been first moved to the on position (see FIG. 2).

The main components of the electrical control device 10 may be constructed of any suitable material but it is presently preferred that they be of polymeric material such as polyolefins and the like for economy of manufacture and electrical insulation. Housing 12 is preferably of two portions which can be mated together to form essentially a complete enclosure and suitably fastened to each other with bolts or the like fasteners. It is further contemplated that coil spring 32 could be replaced by other types of biasing means such as other forms of springs or even that suitable biasing means are incorporated within switch 18 itself.

In operation of control device 10, spring 32 will normally bias the interior end of handle element 26 against the switch actuator 20 so as to move it into the off position. To activate the tool (not shown) used in conjunction with the control device 10, the operator grasps the exterior end of handle element 26 and rotates the handle element 26 in the direction of arrow A. Then, the operator uses his finger to actuate trigger element 30. As is apparent, the interior end of trigger element 30 will bear against actuator 20 of switch 18 and cause the switch actuator to travel to the on position. Release of handle element 26 by the operator allows spring 32 to force the handle element 26 to rotate around pivot 28 so that the interior end of handle element 26 will move actuator 20 into the off position and thereby deactivate the tool. It is important that trigger element 30 be pivoted in such a position within handle element 26 that pressure applied to the trigger element against the bias of projecting arm 38 is insufficient to activate switch 18.

Thus, control device 10 according to the invention provides a control means for an electrical type tool which is of the "dead-man" type, i.e., the tool can only operate when actively engaged by the operator and a control means which requires two separate and distinct operations by the operator to activate the tool, i.e., a motion to rotate the handle element relative to the housing and as well as an applied pressure to the trigger element.

While there has been shown and described what is considered to be a preferred embodiment of the present invention, it will be apparent to those skilled in the art that various changes and modifications may be made therein without departing from the invention as defined in the appended claims.

It is claimed:

1. A dead man-type electrical control device for an electrical tool which comprises a housing, an electrical switch mounted within said housing, said electrical switch including a projecting actuator having opposite first and second sides and being movable into an on position or an off position, a handle assembly, said handle assembly including an elongated handle element which is mounted to pivot around an axis within said housing and which defines a first end that extends away of said housing and a second end that is within said housing and is movable against said first side of said projecting actuator, and a trigger element which is pivotally mounted with respect to said handle element and which defines a first end that extends away of said housing and a second end that is within said housing and is movable against said second side of said projecting actuator, and biasing means which contacts said second end of said handle element to pivot said handle element such that said second end of said handle element contacts said first side of said actuator and moves said projecting actuator into said off position, whereas manual pivoting of said handle element against the bias of said biasing means and the manual pivoting of said trigger element with respect to said handle element will cause said second end of said trigger element to contact said second side of said projecting actuator and move said projecting actuator into said on position.

2. An electrical control device in accordance with claim 1, wherein the biasing means is a spring.

3. An electrical control deivce in accordance with claim 2, wherein the spring is a coil spring positioned about said pivot axis.

4. An electrical control device in accordance with claim 1, wherein said handle element is L-shaped.

5. An electrical control device in accordance with claim 1, wherein said trigger element is separate from said handle element.

6. An electrical control deive in accordance with claim 5, wherein said handle element provides a pivot means and wherein said trigger element is rotatably mounted on said pivot means.

* * * * *